US005714047A

United States Patent [19]

Pedrazzini

[11] Patent Number: 5,714,047

[45] Date of Patent: *Feb. 3, 1998

[54] ACID AQUEOUS PHOSPHATIC SOLUTION AND PROCESS USING SAME FOR PHOSPHATING METAL SURFACES

[75] Inventor: Cesare Pedrazzini, Milan, Italy

[73] Assignee: Novamax ITB S.r.l., Italy

[ * ] Notice: The term of this patent shall not extend beyond the expiration date of Pat. No. 5,597,465.

[21] Appl. No.: 727,947

[22] Filed: Oct. 9, 1996

Related U.S. Application Data

[63] Continuation-in-part of Ser. No. 509,535, Jul. 31, 1995, Pat. No. 5,597,465, which is a continuation-in-part of Ser. No. 372,225, Jan. 13, 1995, abandoned.

[30] Foreign Application Priority Data

Aug. 5, 1994 [IT] Italy ..... MI94A1715

[51] Int. Cl.[6] ..... C25D 13/20

[52] U.S. Cl. ..... 204/486; 148/259

[58] Field of Search ..... 204/484, 486; 148/259

[56] References Cited

U.S. PATENT DOCUMENTS 5,597,465 1/1997 Pedrazzini ..... 204/486

FOREIGN PATENT DOCUMENTS 0228151 8/1986 European Pat. Off. .
0224190 11/1986 European Pat. Off. .
0264151 10/1987 European Pat. Off. .
2179680 3/1987 United Kingdom .

OTHER PUBLICATIONS

Abstract, Industrie--Lackierbetrieb, 12, 413 (1991) no month available.

Abstract, La phosphatation des maetaux, 20–21, Ed. Eyrolles (1973) no month available.

D. Saatweber Herberts GmbH, "Galvanized Sheet and Cationic ED Primer: Synergism for Finishing Optimitatior", (no date availaible).

*Primary Examiner*---Arun S. Phasge
*Assistant Examiner*---Kishor Mayekar
*Attorney, Agent, or Firm*---Hedman, Gibson & Costigan, P.C.

[57] ABSTRACT

An acid aqueous solution useful for phosphating metal surfaces and a phosphating process using same; said solution, which is characterized by its containing hydroxylamine phosphate as accelerator and a cationic surfactant can be applied to metal surfaces based on iron, zinc, aluminium and alloys thereof, and is specifically suitable for preventing the formation of white spots.

15 Claims, No Drawings

ACID AQUEOUS PHOSPHATIC SOLUTION AND PROCESS USING SAME FOR PHOSPHATING METAL SURFACES

This is a Continuation-in-Part application of Ser. No. 08/509,535 filed on Jul. 31, 1995, now U.S. Pat. No. 5,597,465, which is a Continuation-in-Part application of Ser. No. 08/372,225 filed on Jan. 13, 1995, now abandoned.

FIELD OF THE INVENTION

The present invention relates to an acid aqueous phosphatic solution and a phosphating process using same to obtain a phosphatic film covering metal surfaces, said film providing excellent corrosion protection and adhesion toward coatings, in particular the coatings obtained by electrocoating. Surprisingly, the phosphating process carried out at low temperatures on metal surfaces based on iron, zinc, aluminium, and steel, is capable of preventing white spots formation, a phenomenon constituting a problem deeply felt especially by the automobile industry.

PRIOR ART

Since 1917, films obtained from phosphatic aqueous solutions have been used to prevent corrosion, prolong the short life of metal surfaces, and improve the paint coating adhesion: the metal surface reacts with the solution to form a phosphate layer, which is either amorphous or crystalline depending on the operating conditions.

Some phosphatic solutions have found extensive application and gained great commercial importance. Said solutions generally contain phosphate ions, zinc and/or manganese and a component, if any, selected among nickel, cobalt, copper, magnesium, calcium, nitrite, nitrate, chlorate and fluoride.

Although, at present, the quality levels of phosphatic solutions are satisfactory, improvements are continuously demanded, in particular by the motorcar industry, owing to the new requirements set by the development of the metal substrates used.

Furthermore, the average life of motor vehicles is now slightly longer than 10 years, whereas no treatment capable of preserving bodies from corrosion and allowing said life to be as long as 10 years has been developed so far.

The metal supports used at present are based on iron, aluminium, zinc, and preferably zinc plated steels (galvanized or electroplated) which, after paint application, proved to be the most resistant to corrosion. The zinc layer efficiency in preventing corrosion phenomena as well as its good adhesiveness result from zinc being reactive with $CO_2$ and atmospheric oxygen, which causes the formation of zinc hydroxycarbonate that quickly adheres to the metal surface and inhibits further corrosion phenomena. Zinc also provides cathodic protection to steel, acting as the anode and undergoing corrosion instead of steel.

As concerns low-zinc-content solutions, the phosphating mechanisms seem to be the following:

on steel $$2\ Zn^{2+}Fe^{2+}+2\ PO_4^{3-}\rightarrow Zn_2Fe(PO_4)_2\cdot 4H_2O\ \text{(phosphophyllite)}$$

on zinc $$3\ Zn^{2+}+2\ PO_4^{3-}\rightarrow Zn_3(PO_4)_2\cdot 4H_2O\ \text{(hopeite)}$$

In the case of solutions containing other metal $Me^{II}$ ions in addition to zinc, such as manganese ions, magnesium ions etc., the phosphatic layer seems to consist of:

$$Zn_xMe^{II}_y(PO_4)_2\cdot 4H_2O$$

pseudo-phosphophyllite, when x=1 and y=2;

pseudo-hopeite, when x=2 and y=1.

Crystalline phosphating processes are always conducted in the presence of an accelerator, i.e. an oxidizer, generally inorganic and sometimes organic, meant for obtaining surface conversion in a shorter and industrially acceptable time. The accelerator action is twofold: it depolarizes the metal surface by acting in particular in the high electronic density (microcathodic) areas, and at the same time oxidizes the metals dissolved in the microanodic attack area causing their precipitation as insoluble phosphatic salts.

Various accelerators, i.e. oxidizers, reducers, or mixtures thereof, are used at the present state of the art.

The nitrite (preferably as a sodium salt) is—among external components—the most widely used accelerator in microcrystalline phosphating processes.

The success of nitrite reasonably results from its easy availability, low cost and high oxidizing power. However, the use of nitrite and/or nitro derivatives meets with insurmountable ecological problems, which cannot be dealt with successfully in compliance with the regulations in force. In fact, this compound has major drawbacks from the technical and ecological points of view, being thermally unstable under the usual operating conditions. Said instability inevitably brings about the formation of nitrogen oxide, whose vapours—having general formula $NO_x$—vented to the atmosphere are highly polluting and aggressive. Furthermore, in the processing baths, nitrite tends to be converted to nitrate ions, which require a troublesome treatment in purification plants. The aforesaid problems as well as the serious hazard connected with nitrite industrial handling and storage (a toxic and comburent substance according to EC standards in force) involve high operating costs, with no certainty of operating in compliance with the regulations in force.

In view of the aforementioned problems, there is an urgent need for finding an alternative accelerator free from nitro derivatives and capable of providing technological performances that may at least approximate to those of the traditional processes based on nitrite.

That is why the attention has been turned again to hydroxylamine, an ecologically safe product, which has been used as accelerator of phosphating processes since the early '50s.

However, the procedures using hydroxylamine cannot be used for phosphating zinc plated steels and surfaces based on aluminium and iron, because of the formation of white spots, i.e. punctiform white efflorescences of variable size (average diameter: 50 to 150 μm; average height: 100 to 400 μm), which are spread at random on the phosphated zinc plated surface after the phosphating stage (D. Saatweber, Galvanized Sheet and Cationic ED Primer: Synergism for Finishing Optimization, ATA 27th Feb., 1989, Milan, Italy, Surface Finishing and Corrosion Protection in Automobiles). The successive cathode-type electrocoating does not correct said defects, but replicates extrudates and layer exactly: therefore, the finished product is absolutely unacceptable.

The chemical nature of said phenomenon, also known as "white specking" or "nubbing", has not been fully clarified yet; however, its origin seems electrochemical. In fact, it was found that the cathodic polarization of zinc plated surfaces can prevent white spots formation (W. Rausch, Industrie Lackerbetrieb, 1981, 12,413).

When fed to the phosphating bath, the metal surfaces to be treated, in particular the surfaces based on zinc, usually exhibit non-uniform residual oxidation areas. It follows that preferential polarities arise in the course of the phosphating process, which always includes a preliminary pickling stage, wherein the phosphoric acid generated by the phosphatic system produces superficial etching. Anodic corrosion develops locally in the acid medium, with formation of punctiform cavities characterized by a vacancy of surface layer zinc. In the surface areas where iron is exposed, a "galvanic cell" probably operates on iron and metal zinc, thus allowing zinc dissolution to continue. Consequently, zinc hydroxides and phosphates might precipitate in excessive mounts and accumulate at the cavity limits. Phosphated surfaces would thus exhibit small blackish cavities characterized by lateral whitish deposits, mainly consisting of zinc hydroxides and phosphates, which would form the typical swollen efflorescence (Guy Lorin, La phosphatation des metaux, 20–21, Edition Eyrolles, 1973).

As already mentioned, this phenomenon is particularly pronounced when hydroxylamine is used as phosphating accelerator.

According to the prior art, the only remedy for removing the white spots that form after the phosphating process is of mechanical type, e.g. sanding or rubbing with paper or cloth. Such a hand-performed operation clearly involves too high costs of labour to be commercially viable.

Different solutions of the problem connected with white spots formation have been proposed in specific cases.

By way of example, European patent EP 228,151 discloses a phosphating bath containing zinc, $PO_4$ ion, manganese, and fluoride ions, and provides for the use of various accelerators, such as nitrite and nitro derivatives, but not hydroxylamine. According to the inventors, the problem of white spots formation may be partially solved by reducing the concentration of chloride ions in the phosphatic solution and, obviously, also of chlorate ions which, by reduction, slowly give chlorides.

British patent application GB 2,179,680 identifies the presence of chloride ions as one of the major causes for white spots formation and provides for a phosphating solution that can be applied to zinc plated metal surfaces as a film capable of reducing said phenomenon. This result would be attained—though not to a wholly satisfactory extent—by nullifying the effect of chlorides through proportional additions of fluorides. In fact, the aforesaid solution should contain fluorides at a $F^-/Cl^-$ ratio at least of 8:1 by weight. Furthermore, the chloride ions concentration should be of 50 ppm max., preferably of 20 ppm max., and optionally pretreatments of the metal surface should be carried out with solutions having a chlorides content of 100 ppm max. Said limits may be hardly proposed to the industry: in fact, values of 20 or 50 ppm are often exceeded even only by the main water salinity and may be easily reached also in phosphating baths prepared with demineralized water, owing to the drag out of main water used for previous washings.

European patent EP 0264151 looks for the solution of the problem of white spots in a metal surface pretreatment stage and provides for a rinse operation—prior to activation—with a solution containing a mixture of sodium silicates, borates and nitrites.

European patent EP 0224190 discloses the use of an activating solution based on titanium phosphates, added with disodium tetraborate or other alkaline borates at a $PO_4/B_4O_7$ ratio of 1 min. Addition of $B_4O_7$ reduces the formation of white spots, which thus occurs at widely separated intervals, but does not wholly eliminate the phenomenon. Moreover, as disclosed in said patent, a serious pollution problem is brought about by the high amounts of $Na_2B_4O_7.10\ H_2O$ required (4 to 8 g/l).

None of the aforementioned patents provides for the use of hydroxylamine as accelerator.

It is clear that the problem of white spots has not been solved so far: in particular, the problem hardly admits solution if hydroxylamine is used as accelerator, which makes the problem particularly serious.

SUMMARY

It has surprisingly been found that an acid aqueous solution containing hydroxylamine phosphate and a cationic surfactant of the class of the ammonium surfactants, allows the obtainment, within a time meeting industrial requirements, of phosphatic layers having good corrosion resistance and adhesion to a paint coating, without formation of white spots.

It is a further object of the present invention a process, based either on spraying or on immersion, for phosphating metal surfaces with said solution, at a temperature of 40° C. to 55° C., for a period of 1 to 5 minutes.

DETAILED DESCRIPTION OFT HE INVENTION

The following detailed description sets forth characteristics and advantages of the phosphating solution and of the process using same according to the present invention.

The present invention relates to an acid aqueous phosphating solution containing hydroxylamine phosphate and a cationic surfactant, of the class of the Ammonium surfactants, at given concentrations and ratios.

More precisely, the present invention relates to phosphating solutions containing 0.6 to 3.0 g/l hydroxylamine phosphate and 0.001 to 1 g/l of cationic surfactant, preferably 0.005 to 0.1 g/l. The hydroxylamine phosphate/cationic surfactant ratio may range from 0.6 to 1000 by weight, preferably from 10 to 200.

The hydroxylamine phoasphate can be formed "in situ" by adding hydroxylamine base in the acid phosphatic solution.

The solution may also contain 0.003 to 0.08 g/l of copper ions; 0.05 to 0.3 g/l of at least a polyfunctional sequestering agent selected from the group consisting of aminated polyacid complexing agents acting as accelerators, such as EDTA, and organic polyacids, such as tartaric and citric acids, and preferably EDTA and/or tartaric acid at a concentration of 0,08 to 0,1 g/l; an amount of non-ionic emulsifier, acting as defoaming agent, compatible with the phosphating process and the usual passivation and electrocoating treatments, ranging from 10 to 30% by weight of the cationic surfactant content.

A typical phosphating compositions according to the present invention conveniently contain:

5 to 25 g/l phosphate ions;

0.5 to 2.0 g/l zinc ions, preferably 0.5 to 1.5 g/l;

1.5 to 4.0 g/l nitrate ions;

0.3 to 1.2 g/l manganese ions;

0.001 to 0.1 g/l iron ions;

0.4 to 1.1 g/l nickel ions;

0.3 to 1.2 g/l total fluoride ions, deriving from hydrofluoric acid, fluorosilicilic acid or other suitable sources;

0.6 to 3.0 g/l hydroxylamine phosphate; and 0.001 to 1 g/l cationic surfactant, preferably 0.005 to 0.1 g/l.

In the phosphating composition of the invention, said amount of nickel ions may be substituted by a combination of magnesium and cobalt ions, wherein magnesium ions range from 0.5 to 1.5 g/l and cobalt ions range from 0.05 to 0.2 g/l.

Since, as previously mentioned, the nature of white spots has not been clarified yet, also the action produced by the hydroxylamine phosphate/cationic surfactant system can be hardly understood.

This is even more surprising because it is only hydroxylamine phosphate, and not other hydroxylamine salts, that produces the result intended, also after a long operation time of the phosphating bath.

Any chemical mechanism acting through hydroxylamine phosphate and not, e.g., the corresponding sulphate, can be hardly hypothesized.

It is also surprising that, among the various surfactants tested, the anionic surfactants tend to increase white spots formation, whereas non-ionic surfactants do not affect the occurrence of said phenomenon. Suitable cationic surfactants are the ammonic ones selected from the groups consisting of:

a) alkyl polyglycolethers of ammonium chloride or sulphate or phosphate the cation being of formula:

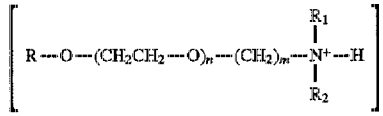

(I)

where n=1 to 12, m=1 or 2, $R_1$, $R_2$=H or methyl, with R being a linear or branched alkyl containing from 10 to 22 carbon atoms.

Particularly preferred are the compounds of formula (I), where n ranges from 3 to 6, with R being $C_{12}$–$C_{14}$ alkyl, which prove to be highly effective for white spots removal.

b) polyethoxylated and polypropoxylates of alkylammonium salts (in particular chloride, sulphate or phosphate) obtained by salifying the ammonic compounds represented by the formulas:

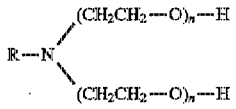

(II)

or

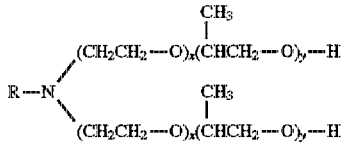

(III)

wherein R is a linear or branched alkyl containing from 10 to 22 carbon atoms, n=4 to 12, preferably 5 to 9, x=4+12 and y=2+12. The sequence of the ethoxy and propoxy units in formula III can be of the type "random" or of the type "block". The phosphate salt can be obtained in situ by adding the basic ammonic compounds of the above formulas to the acid phosphating bath.

c) N-alkylammonium salts, in particular choride or phosphate, having cation of formula:

$$R\ HN^{(+)}\ R_1\ R_2$$

wherein R is alkyl residue having 12 to 18 carbon atoms, $R_1$ and $R_2$ are H or methyl.

Although the connection of white spots formation with the presence of chlorides has not been demonstrated, evidences have been provided that white spots are completely removed in the presence of a cationic surfactant at a surfactant/chlorides ratio between 1:1 and 1:30 by weight and preferably between 1:3 and 1:10.

It has also been found that the copper ion if contained in the claimed solution contributes to the improvement in quality of the phosphatic layer, which becomes more conductive. Said advantageous use of copper ions is made possible by the presence of the hydroxylamine phosphate/cationic surfactant system which, in any case, hinders the formation of white spots. In the absence of said system, copper ions cause white spots formation already at concentrations of 0.003 to 0.005 g/l.

The phosphatic solution according to the present invention exhibits a total acidity value ranging from 10 to 28 points, a free acidity value ranging from 0.5 to 2.0 points, at an acid ratio (i.e. total acidity/free acidity ratio) of 5 to 56. With said acidity values, phosphatic films may be obtained at a low cost and the metal surface does not undergo pronounced corrosion.

In the present description, the total acidity value refers to the number of milliliters of 0.1N NaOH necessary to titrate 10 ml of the claimed phosphatic solution using phenolphthalein as indicator and the free acidity value refers to the number of milliliters of 0.1N NaOH necessary to titrate 10 ml of the claimed phosphatic solution using methyl yellow as indicator.

The phosphating process according to the present invention may be conducted by spraying or immersion or a combination thereof, for a period of 1 to 5 min., at a temperature of 40° C. to 55° C. At temperatures below said range, acceptable layers could be obtained only after long processing times, whereas at temperatures above said range, the phosphating accelerator would decompose more quickly, which would unbalance the solution components concentrations and make it difficult to obtain satisfactory phosphatic films.

The microcrystalline phosphate layer obtained on the basis of the procedure of the present invention weighs 1.5 to 5.0 g/m2.

The claimed process, carried out either by spraying or by immersion, reduces white spots formation of 98%.

The phosphatic film can be satisfactorily applied also to complex-shaped articles, such as automobile bodies.

The phosphating process based on immersion according to the present invention is carried out at a temperature preferably ranging from 45° C. to 50° C., for a period of 2 to 5 min.

The acid aqueous phosphatic solution used in said treatment preferably contains 13 to 15 g/l phosphate ions, 1.0 to 1.5 g/l zinc ions, 2.5 to 3.5 nitrate ions, 0.6 to 1.1 g/l manganese ions, 0.001 to 0.05 g/l iron ions, 0.4 to 0.6 g/l nickel ions, 0.6 to 0.8 g/l fluoride ions, 1 to 2 g/l hydroxylamine phosphate and 0.01 to 0.1 g/l cationic surfactant. The solution may also contain 0.05 to 0.3 g/l organic polyfunctional sequestering agent, preferably EDTA and/or tartaric acid and optionally also 0.003 to 0.006 g/l copper ions.

The total acidity value preferably ranges from 18 to 22 points and the free acidity value from 1 to 2 points.

Said procedure by immersion yields microcrystalline phosphatic layers weighing 1.5 to 3.5 g/m2 on iron substrates, and 2 to 5 g/m2 on zinc plated sheets.

The phosphating process based on spraying according to the present invention is carried out at a temperature preferably ranging from 45° C. to 50° C., for a period of 1 to 3 min., under a spraying-pressure of 1 to 2.5 atm.

The acid aqueous phosphatic solution used in said spraying treatment preferably contains 9.0 to 11.2 g/l phosphate ions, 0.8 to 1.2 g/l zinc ions, 1.7 to 3.0 nitrate ions, 0.4 to 0.7 g/l manganese ions, 0.001 to 0.04 g/l iron ions, 0.4 to 0.5 g/l nickel ions, 0.4 to 0.7 g/l fluoride ions, 0.8 to 1.6 g/l hydroxylamine phosphate and 0.01 to 0.1 g/l cationic surfactant.

The solution may also contain 0.05 to 0.3 g/l organic polyfunctional sequestering agent, preferably EDTA and/or tartaric acid and optionally also 0.003 to 0.006 g/l copper ions.

The total acidity value preferably ranges from 13 to 14 points and the free acidity value from 0.6 to 0.8 points.

Said procedure by spraying yields microcrystalline phosphatic layers weighing 1 to 3.5 g/m2 on iron substrates, and 1.5 to 3.5 g/m2 on sheet iron zinc plated electrolytically.

According to the procedure of the present invention, immersion and immersion/spraying treatments are preferred to spraying and spraying/immersion treatments.

Finally, a treatment combining spraying with immersion may consist of immersion at 45° C. to 50° C., for a period of 100 to 200 sec., followed by spraying at 45° C. to 50° C., for a period of 20 to 50 sec., or of spraying at 45° C. to 50° C., for a period of 20 to 50 sec., followed by immersion at 45° C. to 50° C., for a period of 100 to 200 sec. The treatment based on immersion followed by spraying is particularly suitable for complex-shaped articles, such as automobile bodies.

The constituents of the acid aqueous phosphatic solution of the present invention may be obtained from the following compounds:

hydroxylamine phosphate is a stable salt of formula $(NH_2OH)_3.H_3PO_4$ or $(NH_3OH)_3.PO_4$. It is to be stressed once again that a hydroxylamine salt other than phosphate cannot be used in the phosphating solutions of the invention. In particular, it would be profitable from an industrial point of view to use hydroxylamine sulphate, a low-cost and easily-available stable salt; however, said use proved to be impossible because sulphate ions in amounts higher than 500 ppm, favour white spots formation, i.e. they act as chloride ions.

The source of phosphate ions may be phosphoric anhydride, phosphoric acid, zinc phosphate, zinc monohydrogen phosphate, zinc dihydrogen phosphate, manganese phosphate, manganese monohydrogen phosphate, manganese dihydrogen phosphate, etc., and preferably phosphoric acid.

The source of zinc ions may be zinc oxide, zinc carbonate, etc., and preferably zinc oxide.

The source of manganese ions may be manganese carbonate, manganese oxide, the aforementioned manganese phosphates, etc., and preferably manganese carbonate.

The source of iron ions is preferably ferric nitrate; nevertheless, at the initial step of preparation of the phosphating bath, it is possible even not to add iron to said bath, since iron ions can form spontaneously during the phosphating of iron-based surfaces, due to the acid attack of the same surfaces.

The source of nickel ions may be nickel nitrate, nickel carbonate, nickel phosphate, etc., and preferably nickel nitrate.

The source of fluoride ions may be fluosilicilic acid, hydrofluoric acid, fluoboric acid, and metal salts thereof, and preferably fluosilicilic acid.

The copper ions are preferably added to the solution as copper nitrate.

Finally, with a view to obtaining the aforesaid acidity values, the solutions may be modified or added with alkaline metal hydroxides, ammonium hydroxide, and preferably sodium hydroxide.

The metal surfaces to be treated according to the present invention include surfaces based on iron, zinc, aluminium and/or their respective alloys. Said metal surfaces may be treated either singly or in combination. Owing to the complete absence of the "white spots" phenomenon the phosphatic solution of the present invention is particularly suitable for the surfaces of zinc or zinc plated steel.

The new process is particularly advantageous for articles consisting of zinc- and iron-based surfaces, as is the case of automobile bodies.

Examples of zinc-based surfaces are zinc plated sheet steel, skimmed sheet steel, sheet steel zinc plated by electrodeposition, sheet steel zinc-alloy plated by electrodeposition, and complex sheet steel zinc plated by electrodeposition.

The acid aqueous phosphatic solutions of the present invention may be conveniently prepared by diluting an aqueous concentrate containing the solution constituents at the right ratios by weight and adding some elements, as required, e.g. pH adjusting agents or accelerators.

The process of the invention includes advantageous pretreatments of the metal surfaces, i.e. degreasing with weakly or strongly alkaline degreasers or with acid degreasers, followed and/or preceded by one rinse with water. The metal surfaces may be then subjected to conditioning with a titanium or zirconium solution. Particularly suitable for the purpose is a solution containing 0.0003% to 0.05%, preferably 0.0005% to 0.001%, titanium on phosphatic support.

Furthermore, once phosphating has been carried out according to the invention, the phosphated surfaces—especially if a coating of same is envisaged—undergo advantageous posttreatments, such as a rinse with a dilute chromic solution containing, e.g., 0.025% to 0.1% chromium in the form of chromium (III) or chromium (VI) or a mixture thereof.

Alternatively, it is possible to perform rinses with aqueous solutions containing poly-4-vinyl phenols or condensates thereof with an aldehyde or a ketone.

It is also possible to perform passivation treatments with metal salts, such as aluminium, zirconium, etc.

Once the aforesaid final rinses have been made, the surfaces exhibit a good resistance to corrosion and a good adhesion to the paint layer later applied by cathode-type electrocoating, since no white spots formation occurred.

The following examples are reported by way of indication, not of limitation of the present invention.

EXAMPLE 1

Influence of Anionic, Cationic and Non-Ionic Surfactants on White Spots Formation Materials and Methods Tests were conducted on steely sheets, zinc plated on both sides (with an 8 to 10 μm thick zinc layer) by electrodeposition, i.e. by electrolytic zinc plating. The said sheets were treated according to the following operating cycle:

Degreasing Stage

The degreasing solution used consisted of:

| | |
|---|---|
| Disodium phosphate | ca. 7 g/l |
| Sodium metasilicate.5 $H_2O$ | ca. 7 g/l |
| Trisodium phosphate.12 $H_2O$ | ca. 3 g/l |
| Neutral sodium pyrophosphate | ca. 1.8 g/l |

-continued

| | |
|---|---|
| Non-ionic surfactants | ca. 1 g/l |
| Hydrotropes | ca. 1 g/l |

The treatment was carried out by immersion at a temperature of 55° C. to 60° C., for a period of 3 to 5 minutes.

Activation Stage

The activating solution used consisted of:

| | |
|---|---|
| Titanium | 5 to 6 mg/l |
| $PO_4$ | 150 to 200 mg/l |
| $P_3O_{10}$ | 450 to 500 mg/l |

The treatment was carried out by immersion at a temperature of 20° C., for a period of 1 minute.

Phosphating Stage

Phosphating was carried out by immersion at a temperature of 50° C., for a period of 3 minutes, using standard 5 l vessels constructed of antiacid material, heated electrically to the desired temperature, and maintained under magnetic stirring.

The three different phosphating solutions used consisted of:

| | | | |
|---|---|---|---|
| $PO_4$ ions | ca. | 13 to 15 | g/l |
| Zinc ions | ca. | 1 to 1.2 | g/l |
| $NO_3$ ions | ca. | 3 to 3.5 | g/l |
| Manganese ions | ca. | 1 to 1.2 | g/l |
| Nickel ions | ca. | 0.4 to 0.5 | g/l |
| Iron ions | ca. | 0.005 to 0.02 | g/l |
| Total fluoride ions | ca. | 660 to 715 | mg/l |
| Total acidity value | | 18 points | |
| Free acidity value | | 1.8 points | |

The aforesaid solutions were added with hydroxylamine phosphate (2 g/l), chloride ions (100 ppm, 0.1 g/l), and a surfactant at a concentration of 0.03 g/l:

BATH 1 was also fed with a non-ionic emulsifier consisting of ethylene oxide-propylene oxide block copolymer;

BATH 2 was also added with a cationic surfactant falling within the scope of this invention, in particular alkyl polyglycolether of ammonium chloride of formula (I), where $R=C_{12}$, n=5 and m=1;

BATH 3 was also added with an anionic surfactant, in particular sodium dodecylbenzenesulphonate.

Once the sheets had undergone the aforesaid operating cycle, they were analyzed.

White spots may be seen with the naked eye, but preferably through an optical microscope, being 0.5--1.5 mm microdome-shaped punctiform white efflorescences, which show up on the grey surface of a phosphated sheet zinc plated by electrodeposition.

Results

| Phosphating BATH | White spots (WS) |
|---|---|
| 1 | present on sheets |
| 2 | absent on sheets |
| 3 | massively present on sheets |

The results of said test prove that non-ionic surfactants do not hinder white spots formation, anionic surfactants favour it, and the cationic surfactants of the invention inhibit it.

EXAMPLE 2

Determination of the Ratio of Cationic Surfactant of the Invention to Chloride Ions Suitable for Preventing White Spots Formation Materials and Methods Tests were conducted on steely sheets ($FePO_4$), zinc plated on both sides (with an 8 to 10 μm thick zinc layer) by electrodeposition, i.e. by electrolytic zinc plating. Degreasing and activating stages were as described in Example 1.

Phosphating was carried out by immersion at a temperature of 50° C., for a period of 3 minutes, using standard 5 l vessels constructed of antiacid material, heated electrically to the desired temperature, and maintained under magnetic stirring.

A phosphating bath as per Example 1 was added with hydroxylamine phosphate (2 g/l) and chloride ions (100 ppm; 0.1 g/l). The bath was repeatedly added with alkyl polyglycolether of ammonium chloride of formula (I), where $R=C_{12}$, n=4 and m=1, to obtain the cationic surfactant concentration required for white spots total elimination, even in the presence of chloride ions, which seem to maximize white spots formation.

Results

| Surfactant | White spots (WS) |
|---|---|
| 0 ppm | present |
| 5 ppm | present |
| 10 ppm | present |
| 15 ppm | present |
| 20 ppm | present |
| 30 ppm | absent |

The results of said test prove that a cationic surfactant of the invention/chloride ions ratio of 1:3 is enough to prevent white spots formation.

EXAMPLE 3

Determination of the Max. Amount of Cationic Surfactant of the Invention Usable in Iron Phosphating Process Materials and Methods Two types of ferrous plates were analyzed:

TYPE 1---plate, $FePO_4$ type, according to UNI standard 5961-67 (April 1967), of common use in motor vehicle manufacture;

TYPE 2---0.8 mm thick cold-rolled ferrous plate, type R, available from Q-Panel (U.K.), according to standard 750.

Said plates were treated according to the degreasing and activating stages described in Example 1. Phosphating was carried out by immersion at a temperature of 50° C., for a period of 3 minutes, using standard 5 l vessels constructed of antiacid material, heated electrically to the desired temperature, and maintained under magnetic stirring.

The phosphating solution used consisted of:

| | | | |
|---|---|---|---|
| $PO_4$ ions | ca. | 13 to 15 | g/l |
| Zinc ions | ca. | 1 to 1.2 | g/l |
| $NO_3$ ions | ca. | 3 to 3.5 | g/l |
| Manganese ions | ca. | 1 to 1.2 | g/l |
| Nickel ions | ca. | 0.4 to 0.5 | g/l |
| Iron ions | ca. | 0.005 to 0.02 | g/l |
| Total fluoride ions | ca. | 660 to 715 | mg/l |
| Total acidity value | | 18 points | |
| Free acidity value | | 1.5 points | |

The aforesaid solution was added with hydroxylamine phosphate (2 g/l), chloride ions (150 ppm; 0.15 g/l) and with increasing amounts of alkyl polyglycolether of ammonium chloride of formula (I), where R=$C_{12}$, n=5 and m=1; after each addition of the cationic surfactant, the sheets, after pretreatments, were phosphated according to the aforementioned procedure. The nature of the phosphated layer obtained was examined.

Results

| Surfactant | Quality of the phosphatic layer | |
|---|---|---|
| (mg/l) | TYPE 1 | TYPE 2 |
| 0 | good | good |
| 300 | good | good |
| 500 | good | good |
| 700 | good | good |
| 1000 | good | good |

Said results prove that the cationic surfactants according to the present invention do not affect iron phosphating; therefore, there is no limit to their concentration in the phosphating bath up to 1000 ppm (1 g/l).

EXAMPLE 4

Influence of the Cationic Surfactant of the Invention on the Phosphating of Sheet Iron and Zinc Plated Sheets Materials and Methods Tests were conducted on ferrous sheets zinc plated on both sides by electrodeposition, i.e. by electrolytic zinc plating.

Once degreased and activated as described in Example 1, the sheets were phosphated in the presence and in the absence of the cationic surfactant of the invention of formula (I), where R=$C_{12}$, n=6 and m=1.

Phosphating was carried out by immersion at a temperature of 50° C., for a period of 3 minutes, using standard 5 l vessels constructed of antiacid material, heated electrically to the desired temperature, and maintained under magnetic stirring.

The phosphating solution used consisted of:

| | | |
|---|---|---|
| $PO_4$ ions | ca. 13 to 15 | g/l |
| Zinc ions | ca. 1 to 1.2 | g/l |
| $NO_3$ ions | ca. 3 to 3.5 | g/l |
| Manganese ions | ca. 1 to 1.2 | g/l |
| Nickel ions | ca. 0.4 to 0.5 | g/l |
| Iron ions | ca. 0.005 to 0.02 | g/l |
| Total fluoride ions | ca. 660 to 715 | mg/l |
| Hydroxylamine phosphate | ca. 2 g/l | |
| Total acidity value | 18 points | |
| Free acidity value | 1.5 points | |

The aforesaid solution was added with the following amounts of chloride ions: 50 ppm (solution A), 100 ppm (solution B) and 150 ppm (solution C). For purpose of comparison, solutions containing the aforesaid amounts of chloride and increasing amounts of the cationic surfactant of the invention, i.e. 30 ppm (solution A'), 60 ppm (solution B') and 90 ppm (solution C'), were prepared. Solutions A', B', and C' were also added with a defoaming agent.

Once the aforesaid sheets had undergone the described operating cycle, the presence of white spots was inspected with the naked eye.

Results

| Solution | [$Cl^-$] | Surfactant conc. | WS observed |
|---|---|---|---|
| A | 50 ppm | absent | some |
| A' | 50 ppm | 30 ppm | none |
| B | 100 ppm | absent | many |
| B' | 100 ppm | 60 ppm | none |
| C | 150 ppm | absent | very many |
| C' | 150 ppm | 90 ppm | none |

Said results prove that the cationic surfactants according to the present invention efficiently inhibit white spots formation.

EXAMPLE 5

Scab Corrosion Test and Wet Adhesion Test on Phosphated Plates According to the Present Invention Materials and Methods Tests were conducted on three types of steely sheets:

TYPE 1—Cold-rolled steely plate, $FePO_4$ type;

TYPE 2—Zinc steely sheet plated on both sides (with a 7 μm thick zinc layer) by electrodeposition, i.e. by electrolytic zinc plating;

TYPE B—Hot zinc plated sheet with smooth finishing (with a 10 to 11 μm thick zinc layer).

Said sheets were treated according to the following operating cycle:

Degreasing Stage

The degreasing solution used consisted of:

| | | |
|---|---|---|
| Disodium phosphate | ca. 7 | g/l |
| Sodium metasilicate.5 $H_2O$ | ca. 7 | g/l |
| Trisodium phosphate.12 $H_2O$ | ca. 3 | g/l |
| Neutral sodium pyrophosphate | ca. 1.8 | g/l |
| Non-ionic surfactants | ca. 1 | g/l |
| Hydrotropes | ca. 1 | g/l |

The treatment was carried out by immersion at a temperature of 50° C. to 60° C., for a period of 2 to 5 minutes.

Rinse Stage

The rinse was carried out using common water at room temperature.

Activation Stage

The activating solution used consisted of:

| | | |
|---|---|---|
| Titanium | 8 to 9 | mg/l |
| $PO_4$ | 130 to 150 | mg/l |
| $P_2O_7$ | 310 to 400 | mg/l |

The treatment was carried out by immersion at a temperature of 20° C. to 40° C., for a period of 30 sec. to 120 sec.

Phosphating Stage

Phosphating stage was carried out, both by spraying treatment (A) and by immersion/spraying treatment (B).

A) Phosphating by spraying treatment was carried out at a temperature of about 50° C., for a period of 180 sec.

The phosphating solution used consisted of:

| | | |
|---|---|---|
| Hydroxylamine phosphate | 1.3 | g/l |
| cationic surfactant of formula (I)* | 0.02 | g/l |
| $PO_4$ ions | 21 | g/l |
| Zinc ions | 0.6 | g/l |

-continued

| | |
|---|---|
| $NO_3$ ions | 3 g/l |
| Manganese ions | 1 g/l |
| Magnesium ions | 1 g/l |
| Cobalt ions | 0.1 g/l |
| Iron ions | 0.01 g/l |
| Total fluoride ions | 780 mg/l |
| Total acidity value | 24.5 points |
| Free acidity value | 1.0 points |

*Said surfactant is the alkyl polyglycolether of ammonium chloride of formula (I), where $R = C_{12}$, n = 5 and m = 1;

B) Phosphating by immersion/spraying treatment was carried out at a temperature of about 50° C., for a period of 180 sec., using in the first immersion phase standard 5 l vessels constructed of antiacid material, heated electrically to the desired temperature and maintained under magnetic stirring, followed by spraying for a period of 30 sec.

The phosphating solution used consisted of:

| | |
|---|---|
| Hydroxylamine phosphate | 1.5 g/l |
| cationic surfactant of formula (I)* | 0.02 g/l |
| $PO_4$ ions | 23.5 g/l |
| Zn | 0.7 g/l |
| $NO_3$ ions | 3.5 g/l |
| Manganese ions | 1.1 g/l |
| Magnesium ions | 1.1 g/l |
| Cobalt ions | 0.11 g/l |
| Iron ions | 0.01 g/l |
| Total fluoride ions | 880 mg/l |
| Total acidity value | 27.5 points |
| Free acidity value | 1.3 points |

*Said surfactant is the alkyl polyglycolether of ammonium chloride of formula (I), where $R = C_{12}$, n = 5 and m = 1;

Rinse Stage

The rinse was carried out using common water at room temperature.

Passivation Stage

The treatment was carried out by immersion at a temperature of 20° to 40° C., for a period of 30 to 120 sec., in a passivating solution consisting of:

| | |
|---|---|
| $H_2Cr_2O_7$ | 0.15 g/l |
| $Cr(NO_3)_3$ | 0.20 g/l |

Rinse Stage with Demineralized Water

The rinse was carried out at room temperature, for a period of 10 to 60 sec., by immersion in demineralized water.

All the above mentioned sheets underwent the aforesaid operating cycle, yielding microcrystalline phosphate layers of even appearance, weighing 1.5 to 3.5 g/m$^2$ on iron substrates, and 2 to 4.5 g/m$^2$ on steely sheet zinc plated by electrodeposition or hot-plated. The layer weights obtained, calculated according to Standard UNI/ISO 3892, are summarized hereinbelow:

| PHOSPHATING | WEIGHT OF THE PHOSPHATIC LAYERS (g/m$^2$) | | |
|---|---|---|---|
| TREATMENT | Type 1 | Type 2 | Type 3 |
| SPRAYING | 2 | 3.5 | 3 |
| IMMERSION/ SPRAYING | 3 | 4 | 3 |

The sheets, after the above mentioned operating cycle, underwent a three-coats painting according to a typical automobile treatment (cathodic-epoxidic primer, epoxidic undercoat and alkyd-enamel topcoat), obtaining a total thickness of 95 to 105 μm, and were subsequently subjected to corrosion and adhesion tests, as reported hereinbelow.

Scab Corrosion Test (Outdoor Corrosion)

The coated sheets, painted as above, underwent Scab Corrosion Test according to FIAT standard 500412 (test method 50493/02), relating to the resistance of coatings to corrosion, after chipping damage by stones and other flying objects, and after incisions through the film to the substrate.

The coated test panels were preliminary submitted to a conditioning stage, by immersion in demineralized water, at 38° C. for 120 hours, followed by protection of the panels edges with adhesive tape or wax. At least an hour after said pre-treatment, standardized road gravel was projected by means of a controlled air blast at half part of the coated specimens in a gravellometer, while on the remaining half parts of the specimens an incision was made through the film to the substrate, with an angle of 45 deg. to the edges of the specimens.

Then the panels were exposed to atmospheric agents, being protected against the rain, and they were salt sprayed with a solution of NaCl 5% twice a week.

After an exposure period of 6 months, the sub-film penetration was measured, reporting the corrosion-removal (mm) along incision on either side. The results are as follows:

| TYPE OF SHEET | CORROSION (mm) after treatment (A) | CORROSION (mm) after treatment (B) |
|---|---|---|
| Type 1 | 0–1 | 0–0.5 |
| Type 2 | 2 | 1–1.5 |
| Type 3 | 0 | 0 |

As the max. penetration admitted by the above mentioned FIAT standard is 8 mm after an exposure period of 1 month, the above results prove to be fully satisfactory.

Wet Adhesion Test

After water-immersion of the coated test panels at a temperature of 50°±2° C., for a period of 120 hours, an area of the panels was cross-cutted according to a lattice pattern, through the film to the substrate, and the adhesion was measured following the Tape Test according to ANSI/ASTM D 3359-76.

| Type of sheet | Wet Adhesion* after treatment (A) | Wet Adhesion* after treatment (B) |
|---|---|---|
| Type 1 | 5 | 5 |
| Type 2 | 5 | 5 |
| Type 3 | 5 | 5 |

* According to the scale of adhesion, 5 indicates that no flaking has occurred from the surface of cross-cut area and the edges of the cuts are completely smooth, while 0 indicates that flaking has occurred from more than 65% of the cross-cut surface.

Test of Resistance of Coatings to Chipping Damage by Stones

The coated sheets, painted as above, underwent a test of chip resistance of coatings in a gravellometer, according to ASTM D 3170-74.

| Type of sheet | Chipping damage* after treatment (A) | Chipping damage* after treatment (B) |
|---|---|---|
| Type 1 | 7B | 7B |
| Type 2 | 7B | 7B |
| Type 3 | 6B | 6B |

The resultant chipping effects were evaluated by comparison with a set of reference photographs; 1D indicates more than 250 chips on a surface of more than 6 mm diameter, 3C indicates 100–150 chips on a surface of 3–6 mm diameter, 5B indicates 50–74 chips on a surface of 1–3 mm diameter and 7A indicates 10–24 chips on a surface of less than 1 mm diameter.

EXAMPLE 6

Influence of Cationic Surfactant of the Invention on Phosphatic Films and on Corrosion Resistance Materials and Methods Tests were conducted on two types of steely sheets:

TYPE 1—Cold-rolled steely plate, $FePO_4$ type;

TYPE 2—Zinc steely sheet plated on both sides (with a 7 μm thick zinc layer) by electrodeposition, i.e. by electrolytic zinc plating.

Said panels were treated according to the following operating cycle:

Degreasing Stage

The degreasing solution used consisted of:

| | | |
|---|---|---|
| Disodium phosphate | ca. 7 | g/l |
| Sodium metasilicate · 5 $H_2O$ | ca. 7 | g/l |
| Trisodium phosphate · 12 $H_2O$ | ca. 3 | g/l |
| Neutral sodium pyrophosphate | ca. 1.8 | g/l |
| Non-ionic surfactants | ca. 1 | g/l |
| Hydrotropes | ca. 1 | g/l |

The treatment was carried out by immersion at a temperature of 50° C., for a period of 3 minutes.

Rinse Stage

The rinse was carried out using common water at room temperature, for a period of 1 minute.

Activation Stage

The activating solution used consisted of:

| | |
|---|---|
| Titanium | 8 to 9 mg/l |
| $PO_4$ | 130 to 150 mg/l |
| $P_2O_7$ | 350 to 400 mg/l |

The treatment was carried out by immersion at a temperature of 20° C., for a period of 1 minute.

Phosphating Stage

Phosphating stage was carried out by immersion at a temperature of 50° C., for a period of 3 minutes, using standard vessels constructed of antiacid material, heated electrically to the desired temperature, and maintained under magnetic stirring.

The sheets were phosphated in the absence (Treatment A) and in the presence of 0.09 g/l of the cationic surfactant of the invention of formula (I), where $R=C_{12}$, n=11 and m=1 (Treatment B).

The phosphating solutions used were as follows:

| | | | |
|---|---|---|---|
| $PO_4$ ions | ca. | 13 to 15 | g/l |
| Zinc ions | ca. | 1 to 1.2 | g/l |
| $NO_3$ ions | ca. | 3 to 3.5 | g/l |
| Manganese ions | ca. | 1 to 1.2 | g/l |
| Nickel ions | ca. | 0.4 to 0.5 | g/l |
| Iron ions | ca. | 0.005 to 0.02 | g/l |
| Total fluoride ions | ca. | 660 to 715 | mg/l |
| Hydroxylamine phosphate | ca. | 2 | g/l |
| Total acidity value | | 24 | points |
| Free acidity value | | 1.6 | points |

Rinse Stage

The rinse was carried out by immersion in common water at room temperature, for 1 minute, and then in demineralized water at room temperature, for 3 minutes.

The passivation stage was not performed in order to render more severe the comparison of the results obtained using the aforesaid phosphatic solutions, in the presence or in the absence of the cationic surfactant of the invention.

The sheets underwent the above mentioned operating cycles, yielding microcrystalline phosphate layers of even appearance.

Painting Stage

The above sheets underwent a two-coats painting, according to a typical automobile treatment:

cathodic-epoxidic primer, polymerized at 180° C. for 30 minutes, yielding a thickness of 30–35 μm;

alkyd-enamel topcoat, polymerized at 160° C. for 20 minutes, obtaining a thickness of 35–40 μm.

After the above mentioned operating cycles, the panels were subjected to corrosion tests, as reported hereinbelow.

Corrosion Test

The coated sheets, painted as above, underwent a corrosion test according to ASTM B 117.

After an exposure period of 1000 hours in a salt-fog room, the sub-film penetration was measured, reporting the corrosion (mm) along incision on either side.

| TYPE OF SHEET | CORROSION (mm) after treatment (A) | CORROSION (mm) after treatment (B) |
|---|---|---|
| Type 1 | 0.5–1 | 0.5–1 |
| Type 2 | 2–3 | 2–3 |

The two different operating cycles, involving the absence or the presence in the phosphating solution of the cationic surfactant, according to the present invention, yield similar and excellent results to the salt-fog corrosion test described hereabove. These results prove that the phosphatic films, obtained using the solutions of the invention which prevent white spots formation, provide excellent corrosion protection toward paint coating.

Scab Corrosion Test (Outdoor Corrosion)

The coated sheets, painted as above, underwent Scab Corrosion Test according to FIAT standard 500412 (test method 50493/02), as described in Example 5.

After an exposure period of 4 months, the sub-film penetration was measured, reporting the corrosion-removal (mm) along incision on either side. The results are as follows:

| TYPE OF SHEET | CORROSION (mm) after treatment(A) | CORROSION (mm) after treatment(B) |
|---|---|---|
| Type 1 | 2–3 | 2–3 |
| Type 2 | 0–0.5 | 0–0.5 |

The max. penetration admitted by the above mentioned standard FIAT is 8 mm, after an exposure period of 4 months. The two different operating cycles (A) and (B) yield similar and excellent results to the scab corrosion test described hereabove, proving that the phosphatic films, obtained using the solutions of the invention, provide excellent corrosion protection toward paint coating.

I claim:

1. An acid aqueous phosphatic solution suitable for forming compact and resistant phosphatic films on metal surfaces, in the absence of white spots, said phosphatic solution consisting of a zinc phosphating solution containing hydroxylamine phosphate in a quantity ranging from 0.6 to 3 g/l and a cationic amino which surfactant contained in a quantity ranging from 0.001 to 1 g/l.

2. The phosphatic solution according to claim 1, wherein the weight ratio hydroxylamine phosphate to cationic surfactant is comprised between 10 and 200.

3. The phosphatic solution according to claim 1, wherein said cationic surfactant is contained in a quantity ranging from 0.001 to 0.1 g/l.

4. The phosphatic solution according to claim 1, wherein said cationic surfactant is selected from the group consisting of:

a) alkyl polyglycolethers of ammonium chloride, sulphate or phosphate having a cation of the formula (I):

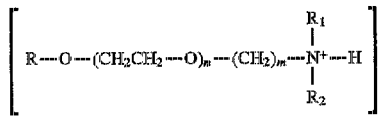

(I)

where n=1 to 12, m=1 or 2; $R_1$, $R_2$=H or methyl, with R being a linear or branched alkyl containing 10 to 22 carbon atoms;

b) polyethoxylated or polypropxylates of alkylammonium salts obtained by salifying ammonic compounds represented by the formulas (II) or (III):

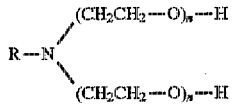

(II)

or

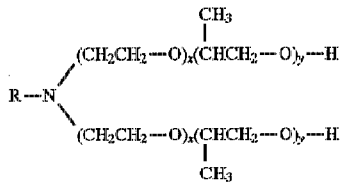

(III)

wherein R is a linear or branched alkyl containing from 10 to 22 carbon atoms and n=4 to 12; x=4 to 12 and y=2 to 12;

c) N-alkylammonium salts, having a cation of the formula:

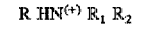

wherein R is an alkyl residue having 12 to 18 carbon atoms, $R_1$ and $R_2$ are H or methyl.

5. The phosphatic solution according to claim 1, containing in addition to said hydroxylamine phosphate and cationic surfactant:

5 to 25 g/l phosphate ions;

0.5 to 2.0 g/l zinc ions;

1.5 to 4.0 g/l nitrate ions;

0.3 to 1.2 manganese ions;

0.001 to 0.1 g/l iron ions;

0.4 to 1.1 g/l nickel ions;

0.3 to 1.2 g/l total fluoride ions.

6. The phosphatic solution according to claim 5, having a total acidity value of 10 to 28 points and a free acidity value of 0.5 to 2.0 points.

7. The phosphatic solution according to claim 5, wherein said zinc ions are contained in a quantity ranging from 0.5 to 1.5 g/l.

8. The phosphatic solution according to claim 5, wherein said nickel ions are substituted by a combination of 0.5 to 1.5 g/l of magnesium ions and 0.05 to 0.2 g/l of cobalt ions.

9. Process for forming a compact and resistant phosphate layer on metal surfaces, in the absence of white spots, said process comprising the step of treating metal surfaces with a zinc phosphatic aqueous solution containing hydroxylamine phosphate in a quantity ranging from 0.6 to 3 g/l and a cationic ammonium surfactant in a quantity ranging from 0.001 to 1 g/l.

10. The Process according to claim 9, wherein said phosphatic aqueous solution contains said hydroxylamine phosphate and said cationic surfactant with a ratio ranging from 10 to 200 by weight.

11. The process according to claim 9, wherein said phosphatic aqueous solution contains in addition to said hydroxylamine phosphate and cationic surfactant:

5 to 25 g/l phosphate ions;

0.5 to 2.0 g/l zinc ions;

1.5 to 4.0 g/l-nitrate ions;

0.3 to 1.2 g/l manganese ions;

0.001 to 0.1 g/l iron ions;

0.4 to 1.1 g/l nickel ions; and 0.3 to 1.2 g/l total fluoride ions.

12. The process according to claim 9, wherein said phosphatic aqueous solution contains in addition to said hydroxylamine phosphate and cationic surfactant:

5 to 25 g/l phosphate ions;

0.5 to 2.0 g/l zinc ions;

1.5 to 4.0 g/l nitrate ions;

0.3 to 1.2 g/l manganese ions;

0.001 to 0.1 g/l iron ions;

0.5 to 1.5 g/l of magnesium ions;

0.05 to 0.2 g/l of cobalt ions; and 0.3 to 1.2 g/l total fluoride ions.

13. The process according to claim 9, wherein said metal surfaces are based on zinc or zinc plated steel.

14. The process according to claim 9, wherein the metal surface to be treated is previously subjected to an activation treatment with an aqueous solution of titanium salts containing 0.0003% to 0.05% by weight of titanium.

15. The process according to claim 9, wherein the said metal surfaces, after phosphating are further treated with an aqueous solution containing from 0.025% to 0.1% by weight of chromium in the form of chromium (III) compounds, chromium (IV) compounds or a mixture thereof, and electrocoated.

* * * * *